US005228262A

United States Patent [19]

Meriwether

[11] Patent Number: 5,228,262

[45] Date of Patent: Jul. 20, 1993

[54] ANCHOR ASSEMBLY

[76] Inventor: Irvin F. Meriwether, 622 Harriot, Beaumont, Tex. 77705

[21] Appl. No.: 778,678

[22] Filed: Oct. 18, 1991

[51] Int. Cl.[5] ..... E04G 21/18

[52] U.S. Cl. ..... 52/704; 52/127.2; 52/149

[58] Field of Search ..... 52/704, 149, 155, 127.2, 52/150, 135; 248/354.3; 249/6, 7, 3

[56] References Cited

U.S. PATENT DOCUMENTS

| | | | |
|---|---|---|---|
| 1,512,165 | 10/1924 | Funkhouser | 249/6 |
| 3,006,592 | 10/1961 | Davis | 248/354.3 |
| 3,444,659 | 5/1969 | Shanni | 52/149 |
| 3,615,110 | 10/1971 | Fugate | 403/230 |
| 4,068,427 | 1/1978 | Camardo | 52/149 |

*Primary Examiner*—James L. Ridgill, Jr.

*Attorney, Agent, or Firm*—Bill B. Berryhill

[57] ABSTRACT

An anchor assembly for anchoring one end of a temporary brace to the ground from which it extends to support an object at its other end. The anchor assembly may comprise a substantially vertical member for longitudinal engagement with a stake to be vertically driven into the ground. A fastening device is attached to the vertical member for fastening the stake to the vertical member after it is driven into the ground. A horizontal base is attached to the lower portion of the vertical member for supporting it on the ground and one or more plate members extend transversely from the vertical member to provide at least one flat surface against which one end of a temporary brace may lie. One or more holes are provided in the plate members through which fastener members may be inserted for fixing the temporary brace to the anchor assembly.

6 Claims, 1 Drawing Sheet

ANCHOR ASSEMBLY

BACKGROUND OF THE INVENTION

1. Field of the Invention

The present invention pertains to anchor assemblies for anchoring one end of a brace to the ground to support an object at its other end. More specifically, the present invention pertains to an anchor assembly for supporting one end of a temporary brace to the ground from which it extends to support a concrete form.

2. Description of the Prior Art

In pouring concrete foundations, walls, etc., forms are usually constructed to delineate the outer surface of the particular concrete structure being formed. These forms may be made of wood or some other material and must be at least temporarily supported against the weight and forces of wet concrete poured into the forms.

Typically, wooden forms are constructed for a concrete foundation or the like in the form of a vertical wall supported by temporary braces which extend, at an angle, from the ground to some point of attachment to the form. There would be several such braces. A typical brace would be a two inch by four inch (2×4) piece of lumber several feet long. To anchor the brace at the ground, a wooden stake is typically driven into the ground and the brace nailed thereto. Although these wooden stakes are usually pointed on the lower end, they are sometimes very difficult to drive into the ground, especially during dry weather. To do so is time consuming and very hard work.

Various devices have been developed to improve efficiency in pouring concrete. A holder for a screed rail is shown in U.S. Pat. No. 4,934,643 which speeds the installation and removal of screed rails for smoothing and leveling of concrete slabs. U.S. Pat. No. 4,898,358 discloses prefabricated form work which is specially designed for curved concrete forms. However, both of these patents are primarily for slabs or other types of concrete structures which do not extend far above the ground.

U.S. Pat. No. 4,068,427 discloses a wall bracing assembly for bracing newly constructed brick or masonry walls until associated permanent bracing is completed. This wall bracing assembly would appear to be effective for its purpose but is more complex and expensive than would be required for temporary concrete foundation and wall forms.

While various concrete form supporting devices have been developed for specific uses, few developments appear to have been made in providing more universal supports for temporary bracing associated with the majority of concrete form work. Thus, temporary wooden bracing anchored by wooden stakes driven into the ground continues to be the most accepted method of supporting concrete forms. Obviously, more efficient methods are needed.

SUMMARY OF THE INVENTION

The present invention provides an anchor assembly for anchoring one end of a temporary brace to the ground from which it extends to support an object, such as a concrete wall form, at its other end. The anchor assembly includes a vertical member for longitudinal engagement with a metal stake to be driven into the ground. Means is provided for fastening the stake to the vertical member after the stake is driven into the ground. Attached to the lower portion of the vertical member, for supporting the assembly on the ground, is a horizontal base. One or more plate members extend transversely from the vertical member providing at least one flat surface against which one end of a temporary brace may lie. One or more holes are provided in the plate members through which fastener members may be placed for fixing the temporary brace to the anchor assembly.

Thus, the anchor assembly may be placed where desired and fastened to a stake driven into the ground. Then one end of a temporary brace, attached at its opposite end to a concrete form, may be laid against the plate members of the anchor assembly and attached thereto by nails, screws or other fastener members placed through the holes in the plate members. This procedure is quite simple, fast and effective. Other objects and advantages of the invention will be understood by reading the description which follows in conjunction with the accompanying drawings.

DESCRIPTION OF A PREFERRED EMBODIMENT OF THE INVENTION

Figure 1:
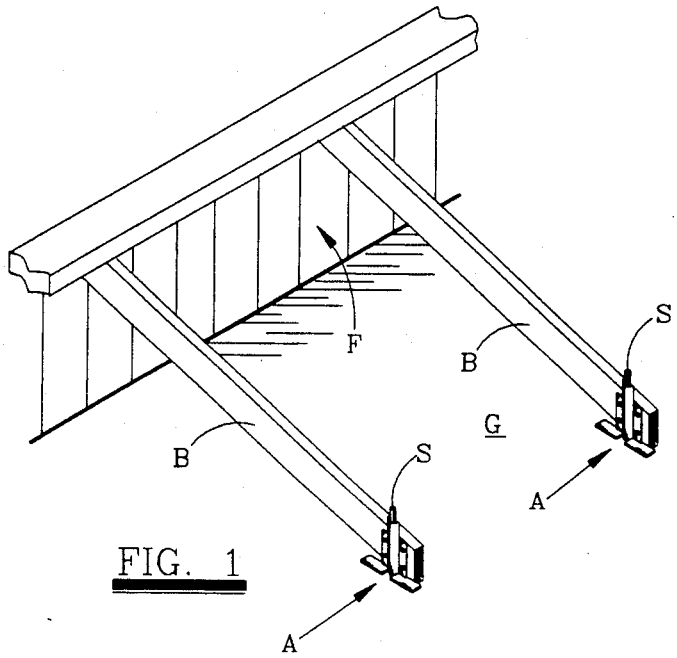
FIG. 1 is a pictorial view of a concrete form being supported by temporary braces the ends of which are anchored to the ground by anchor assemblies, according to a preferred embodiment of the invention.

As illustrated in FIG. 1, there is shown a form F for a concrete foundation or wall supported by several temporary braces B which extend at an angle from the ground G to the form F. The braces B are illustrated as 2×4 lumber members. Each of the braces B is attached near the top of the form F in some suitable manner. The opposite end of each of the braces B is temporarily anchored to the ground by an anchor assembly A.

Figure 2:
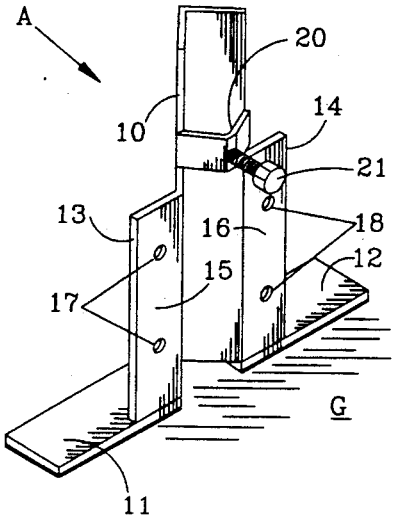
FIG. 2 is a perspective view of an anchor assembly, such as the one shown in FIG. 1, according to a preferred embodiment of the invention.
Figure 3:
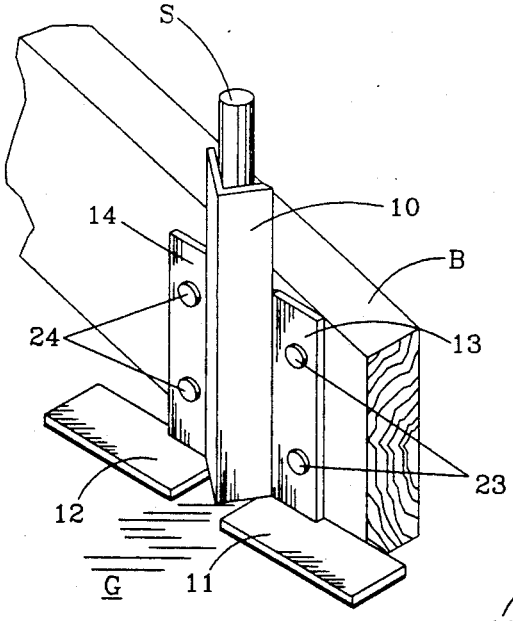
FIG. 3 is a pictorial representation of an anchor assembly, according to a preferred embodiment of the invention, from one side thereof showing one end of a temporary brace fixed thereto.
Figure 4:
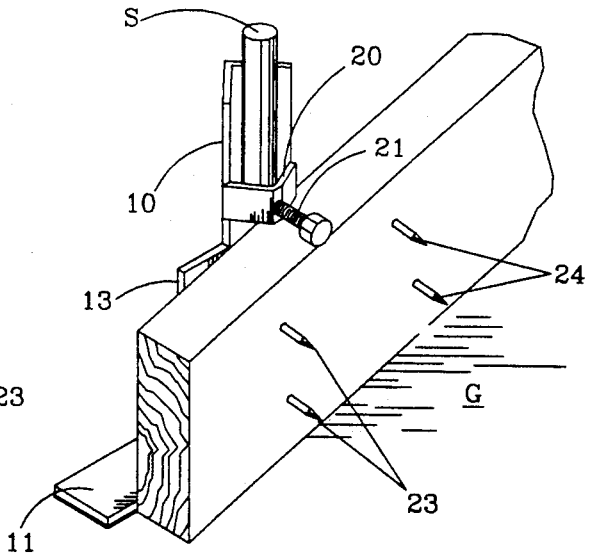
FIG. 4 is a pictorial representation of an anchor assembly, according to a preferred embodiment thereof, from the opposite side of FIG. 3, showing a temporary brace fixed thereto.

Referring now also to FIG. 2, the anchor assembly A comprises a substantially vertical member 10 for longitudinal engagement with a metal stake or rod S (see FIGS. 1, 3 and 4). The vertical member 10, in the preferred embodiment is a piece of angle iron at the base of which are welded horizontal plates 11 and 12 which provide a base for supporting the assembly A on the ground G.

Extending transversely from the vertical member 10 is one or more plate members 13, 14 which provide at least one flat surface 15, 16 against which one end of a temporary brace B may lie, such as shown in FIGS. 1, 3 and 4. It will be noted that one or more holes 17, 18 are provided in these plate members 13, 14 through which nails, screws or other fastener members may be placed.

Attached to an upper portion of the vertical member 10 is a small piece of angle iron or collar 20 having a threaded hole therein for engagement by a set screw or bolt 21 which is mounted at a perpendicular disposition to the vertical member 10. It can be understood that threaded advancement of the screw or bolt 21 in the hole would cause the end of the screw or bolt 21 to project inwardly toward the vertical member 10.

Referring also now to FIGS. 3 and 4, the anchor assembly A is positioned with its base plates 11, 12 against the ground G and a metal stake or rod S is vertically aligned against the vertical member 10 and driven into the ground until the rod S is firmly supported thereby. The angle iron or collar 20, with the vertical member 10, encircle stakes. Then the set screw or bolt 21 is advanced through the threaded hole of collar 20 and tightened against the rod or stake S so that the anchor assembly A and rod S are firmly fastened together. Next, one end of a brace member B is placed against the flat surfaces 15, 16 of the plate members 13 and 14 and positioned so that the brace member B would be disposed to properly support a concrete form, such as the form F in FIG. 1, at its opposite end. Then screws or nails (nails 23 and 24 in the exemplary embodiment) are placed in the holes of the flat members 13 and 14 and driven, or turned in the case of screws, into the brace B such as shown in FIGS. 3 and 4. The brace B is then firmly fixed to the anchor assembly A and the anchor assembly A is firmly anchored to the ground G by the metal stake or rod S.

As shown in FIG. 1, a number of anchor assemblies A and corresponding braces B would then support the concrete form F so that concrete may be poured into the form. After concrete is poured into the form F and sufficient time is allowed for the concrete to set, the temporary braces B may be easily removed from the anchor assemblies A by removing the nails or fasteners 23 and 24. Then the stake or rods S may be removed, after loosening of the set screw 21, and the anchor assembly A removed for use at the next job site.

Thus, the anchor assembly of the present invention is simple to manufacture and use. It is extremely versatile for use with braces of differing lengths and angles. It can be easily installed and is easily removed, after serving its purpose, for use on subsequent jobs.

While a single embodiment of the invention has been described herein, many variations thereof can be made without departing from the spirit of the invention. Accordingly, it is intended that the scope of the invention be limited only by the claims which follow.

I claim:

1. An anchor assembly for anchoring one end of elongated temporary braces of differing lengths to the ground from which they may extend at varying angles to support an object at their other ends, said anchor assembly comprising:

a substantially vertical member for longitudinal engagement with a stake to be driven into said ground;

means for fastening said stake to said vertical member after said stake is driven into the ground;

horizontal base means attached to the lower portion of said vertical member for supporting said assembly on said ground; and one or more plate members extending transversely from said vertical member providing at lest one flat surface against which said one end of one of said temporary braces may lie and having one or more holes therein through which fastener members may be removably placed for fixing said one end of said one temporary brace to said anchor assembly regardless of the angle at which it extends from said ground.

2. An anchor assembly as set forth in claim 1 in which said vertical member comprises an elongated length of angle iron, said means for fastening said stake to said vertical member comprising a member attached to said vertical member having a threaded set screw therein for engagement with said stake after it is driven into the ground.

3. An anchor assembly as set forth in claim 1 in which said horizontal base means comprises one or more flat plates affixed to the lower end of said vertical member for engagement with said ground.

4. An anchor assembly as set forth in claim 1 in which said one or more plate members includes a plate member extending from each side of said vertical member each of which provides a flat surface against which said one end of said temporary brace may lie and at least one of said plate members being provided with one or more holes through which fastener members may be placed for engagement with said one end of said temporary brace.

5. An anchor assembly as set forth in claim 1 in which said means for fastening said stake to said vertical member comprises a collar member which, with said vertical member, encircles said stake, said collar member being a threaded hole therethrough which threadingly receives a set screw which may be tightened against said stake to hold it against said vertical member.

6. An anchor assembly as set forth in claim 1 in which said means for fastening said stake to said vertical member and said fastener members are disengageable from said stake and said brace, respectively, to allow removal of said brace and said anchor assembly for further use.

* * * * *